United States Patent [19]

Hoyer

[11] 3,981,115

[45] Sept. 21, 1976

[54] MOUNTING FACIA PLATES ON BUILDING STRUCTURES

[76] Inventor: Peter Hoyer, Street No. 166 a, 8941 Egg an der Gunz, Bavaria, Germany

[22] Filed: Jan. 27, 1975

[21] Appl. No.: 544,581

[52] U.S. Cl. ..... 52/235; 52/378; 52/486; 403/43

[51] Int. Cl.[2] ..... E04B 5/57; E04B 2/88

[58] Field of Search ..... 52/83, 230, 235, 378, 52/486; 294/89; 403/43, 44, 45; 74/501 R

[56] References Cited

UNITED STATES PATENTS

| | | | |
|---|---|---|---|
| 1,293,383 | 2/1919 | Eaton | 403/43 |
| 2,004,398 | 6/1935 | Steenson | 403/44 |
| 3,422,925 | 1/1969 | Petrie | 403/43 |
| 3,498,013 | 3/1970 | Kern | 52/230 |
| 3,527,002 | 9/1970 | Mead | 52/83 |
| 3,626,508 | 12/1971 | Sharrow | 294/89 |
| 3,760,542 | 9/1973 | Haeussler | 52/235 |
| 3,834,099 | 9/1974 | Haeussler | 52/235 |

*Primary Examiner*—Price C. Faw, Jr.
*Assistant Examiner*—William Randolph
*Attorney, Agent, or Firm*—Holman & Stern

[57] ABSTRACT

Facia plates are mounted on building structures through the agency of a suspension element in the form of a length of flexible wire rope (cable) with an externally-threaded sleeve at each end. One sleeve is threaded into a mating sleeve in the facia plate and the other is adjustably engaged with an element capable of hooked engagement with means on the building structure. This adjustable engagement allows for variation of the effective length of the rope.

3 Claims, 1 Drawing Figure

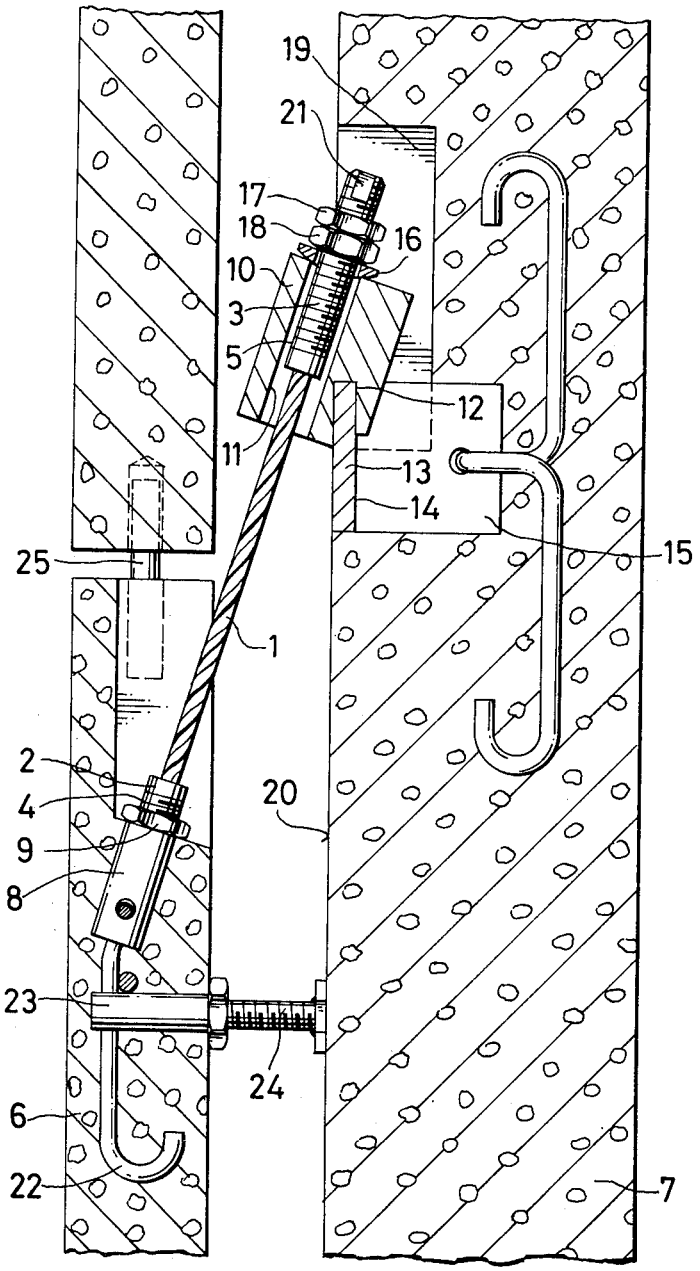
19
21
17
18
16
10
3
5
12
11
13
14
15
25
1
2
4
20
9
8
23
24
6
22
7

MOUNTING FACIA PLATES ON BUILDING STRUCTURES

FIELD OF THE INVENTION

This invention relates to an apparatus for the suspension of facia plates or the like on building structures of the kind comprising a suspension member of adjustable effective length which is hung on the building structure from its upper end and is secured at its lower end to the facia plate, thus permitting an adjustment of the facia plate both parallel to and normal to the wall surface of the structure, and further comprising an arrangement for adjusting the spacing of the facia plate from the wall surface.

BACKGROUND OF THE INVENTION

Apparatus of the kind described is primarily used for suspending facia plates on building structures, but may also be used for the fastening of other building elements, although the fastening of facia plates is the preferred sphere of utilization of this present invention.

Facia plates of the kind here concerned are those which need to be adjustable relatively to the building structure. They have to be capable of adjustment in all three dimensions, and the suspension apparatus must permit an adjustment without the security of the suspension arrangements having to suffer. In particular moreover, it must be possible to perform such an adjustment in easy and simple fashion, that is to say the adjusting elements must be readily accessible and care must also be taken that the adjustment, when made, will not be upset.

As a rule two suspension elements are provided for each plate. The heightwise level can be set by adjustment of the effective position and performed by rocking about a horizontal axis. A lateral movement of the facia plates relatively to the wall surface is also possible within certain limits. The required spacing is achieved by use of a special setting arrangement constituted by spacer screws.

The required adjustment of the facia plate relatively to the wall surface calls for the suspension members to be movable to an adequate degree. The members must therefore have joints both in the region of the attachment to the facia plates and at the point of suspension to the wall surface, and preferably these joints are universally adjustable.

The need to have a suspension member which is in several parts which are pivotable to one another makes the operations with this apparatus difficult. Another problem is to be found in the fact that the superimposed parts must be flush with one another to exclude local excessive stresses and deformation. This is particularly important because, after the facia plates have been erected, there is no longer a facility for access to the suspension members, that is to say inaccurate dispositions cannot afterwards be corrected.

SUMMARY OF THE INVENTION

The object of this invention is to provide an apparatus for the purpose set forth above which comprises a comparatively small number of parts, which is easily made and can readily be handled, and which caters for convenient adjustment of the facia plates into the required positions.

The invention devised is concerned with an apparatus of the type set forth above and proposes that the suspension member shall comprise a length of wire rope having secured, by pressing or swaging to its two ends, sleeves with external threading; one threaded sleeve accommodating the fastening to the facia plate and the other threaded sleeve accommodating the suspension on the building structure and for lengthwise adjustment.

The use for the suspension member of a length of wire rope avoids the need for a plurality of joints in the suspension member. The wire rope is itself sufficiently pliable to permit a required adjustment of the facia plate.

A further substantial advantage of the invention is to be found in the fact that it may be implemented with only a few individual constructional parts, and this is of great advantage where heavy facia plates have to be erected; the production cost is also reduced.

In a further feature, the invention proposes that a suspension element be provided which has a hole which at least partially accommodates the first externally-threaded sleeve and with a slot providing for hooked engagement with attachment means mounted on the building structure. In simplified constructions, the adjusting threading can be carried directly on appropriate elements at the building structure. It is, however, better to have a suspension element which facilitates the fixing to the building structure and allows for proper access to setting nuts on the adjusting threading.

In accordance with a special feature of the invention, a slot is provided in the suspension element for imposition on and clamping to an attachment element which is anchored to the building structure. This element may for example be of U-form. The suspension element can cooperate with the web of the U whilst the limbs of the latter are anchored in the building structure.

The invention further proposes that the second externally-threaded sleeve shall carry a counter nut and thread into an internally-threaded anchorage sleeve in the facia plate. Fastening of the suspension element to the facia plate in this way becomes very simple. In particular the connection can be performed very rapidly at the building site, which has the advantage that the suspension element can be transhipped separately from heavy facia plates, and will be neither damaged nor lost.

BRIEF DESCRIPTION OF THE DRAWING

An embodiment of the invention is illustrated in the accompanying drawing. This drawing is a vertical section through a building structure and parts of superimposed facia plates arranged thereon.

DESCRIPTION OF THE PREFERRED EMODIMENT

The building structure 7 has a recess 19 and arranged at the bottom of this recess is a U-shaped element 13 with its limbs anchored by suitable reinforcing rod in the body of the building structure 7 and its web 14 substantially flush with the surface of this structure.

The apparatus further includes a suspension element having a slot 12 by means of which it is engaged on the web 14. It is clamped to make relative movement between the suspension element 10 and the web 14 practically impossible. The suspension element 10 may be constructed from solid material and have a hole or bore 11 in addition to the slot 12. Other forms are however possible, for example, tubular elements with a part-bottom, or similar.

In the embodiment illustrated, the hole or bore 11 accommodates a sleeve 3 which has outer threads 5; the sleeve 3 is preferably of steel and is secured to the end of a section of wire rope 1 by a pressing or swaging operation. The outer threading 5 is comparatively long to allow for secure adjustment. To this end two lock nuts 17 and 18 are arranged on the threading 5. The end of the sleeve 3 may have a tenon or kerf 21 for engagement by a key, but this is not essential to the present invention.

The lock nut 18 bears on the suspension element 10 through a washer 16. This washer 16 is of spherical formation at its lower face and the end of the hole 11 opposite the washer 16 has a conforming depression so as to ensure appropriate surface contact.

The effect of the washer 16 is to enable the sleeve 3 to adjust in the hole 11 in accordance with the prevailing direction of force application and to an adequate extent, this improving the transfer of stress from the wire rope 1 to the suspension element 10. This facility for adjustment can be dispensed with where lesser forces are involved and where a simpler construction is appropriate, because limited oblique pulls on the sleeve 3 from the wire rope can be accepted without serious problem.

A further sleeve 2 is secured by swaging to the lower end of the wire rope section 1 and this also is provided with external threads 4. This threading 4 can be of short length and the sleeve 2 can moreover be made shorter than the sleeve 3 and its threading 5. The threading 4 is used merely for fastening and not for adjustment.

Sleeve 4 is screwed into a sleeve 8 embedded in the concrete, the latter being provided with internal threading for the purpose. Sleeve 8 is held in the facia plate 6 through an anchorage element 22, this latter also anchoring a similar sleeve 23 for a spacer screw 24 which determines the spacing of the facia plate 6 from the building structure 7.

The depth of screwing of sleeve 2 into sleeve 8 is determined by a counternut 9. If desired the sleeve 2 can also be equipped with key tenone to facilitate its screwing in. This however is not essential. The screwing can be performed through the agency of the wire rope without a twisting of the latter having to be guarded against, because the suspension member is only screwed in and does not screw out.

Preferably, moreover, two pins 25 are provided in the facia plate 6 for the mutual fixing of two plates arranged one above the other. These pins 25 are screwed into sleeves which correspond to sleeves 8 or 23 and can be used for transporting the facia plates. After the transporting elements have been screwed out, particularly by cable loops, ring screws or the like, these sleeves can accommodate the pins 25 which then engage in a corresponding opening at the underside of the plates disposed thereabove.

I claim:

1. In an apparatus for the suspension of facia plates or the like from a building structure comprising a suspension member of adjustable effective length having means at its upper end for suspended engagement with the wall of a building structure and formed with means at its lower end for engagement with a facia plate, means associated with said suspension member permitting adjustment of said facia plate paralell to and normal to the surface of said wall, and an arrangement for adjusting the spacing of the facia plate from said wall surface, the improvement whereby the suspension member comprises a length of flexible wire rope with a first externally-threaded sleeve including means secured to its upper end for engagement with means in hooked engagement with a cooperating portion on the building structure and permitting adjustment of the effective length of the suspension member, and with a second externally-threaded threaded sleeve secured to the lower end of the wire cable and threadedly engaged in a cooperating sleeve anchored in the facia plate, said flexible wire rope providing a universal joint connection between the building structure and facia plate, said means in hooked engagement with the building structure comprising a suspension element including a bore which at least partially, axially accommodates the first externally-threaded sleeve and being of a size to permit free angular movement relative to the longitudinal axis of the sleeve and including a slot providing for hooked engagement with the attachment means on the building structure, said first externally-threaded sleeve carrying at least one lock nut and a washer between this nut and the upper face of the suspension element, said washer having a part-spherical formation at the face thereof, contacting the suspension element for accommodating for the relative axial angular positions of the sleeve in the bore of said suspension element.

2. Apparatus according to claim 1, in which the said attachment means comprises a member of U-form in cross-section, the limbs of the U being anchored in the building structure and the web engaging in said slot of the suspension element.

3. Apparatus as claimed in claim 1, in which the said second externally-threaded sleeve carries a counter nut and threads into an internally-threaded sleeve anchored in the facia plate.

* * * * *